US007551877B2

(12) United States Patent
Murayama

(10) Patent No.: US 7,551,877 B2
(45) Date of Patent: Jun. 23, 2009

(54) IMAGE FORMING APPARATUS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 32 days.

(21) Appl. No.: 11/759,485

(22) Filed: Jun. 7, 2007

(65) Prior Publication Data

US 2007/0286639 A1 Dec. 13, 2007

(30) Foreign Application Priority Data

Jun. 9, 2006 (JP) ..... 2006-161496

(51) Int. Cl.
*G03G 21/16* (2006.01)

(52) U.S. Cl. ..... 399/111; 399/119

(58) Field of Classification Search ..... 399/111, 399/112, 113, 119, 110
See application file for complete search history.

(56) References Cited

U.S. PATENT DOCUMENTS

2004/0136747 A1* 7/2004 Tanizaki et al. ..... 399/110
2004/0244198 A1* 12/2004 Nakashima et al. ..... 29/895.21
2005/0047823 A1* 3/2005 Nakashima et al. ..... 399/111
2006/0083544 A1* 4/2006 Okabe ..... 399/111
2007/0077086 A1* 4/2007 Takakuwa et al. ..... 399/111

FOREIGN PATENT DOCUMENTS

JP 7092801 4/1995
JP 7092881 4/1995
JP 2004013030 1/2004
JP 2004013030 A * 1/2004

* cited by examiner

*Primary Examiner*—David M Gray
*Assistant Examiner*—Laura K Roth
(74) *Attorney, Agent, or Firm*—Banner & Witcoff, Ltd.

(57) ABSTRACT

An image forming apparatus is described. The image forming apparatus may include a main body casing, a reference shaft, a photosensitive unit, developing units and a pressing member. The photosensitive unit is detachably attachable to the main body casing along an attachment/detachment direction, holds photosensitive members, and has an engaging portion. The developing unit has a developing agent carrier. The pressing member is configured to linearly move along the attachment/detachment direction between a press position for pressing the developing unit to press the developing agent carrier into contact with the photosensitive member and a press releasing position for releasing this press contact. The pressing member urges the developing unit in a direction in which the engaging portion comes into engagement with the reference shaft in a process of moving from the press releasing position to the press position.

13 Claims, 3 Drawing Sheets

IMAGE FORMING APPARATUS

CROSS REFERENCE TO RELATED APPLICATION

This application claims priority to Japanese Patent Application No. 2006-161496 filed on Jun. 9, 2006, the disclosure of which is hereby incorporated into the present application.

TECHNICAL FIELD

The present invention relates to an image forming apparatus, such as a color laser printer.

BACKGROUND

Traditionally, an image forming apparatus of a so-called tandem type has been known, in which photosensitive members corresponding to respective colors of yellow, magenta, cyan, and black are arranged in parallel. With the image forming apparatus of the tandem type, toner images for the respective colors are almost simultaneously formed on the respective photosensitive members. Then, with an image forming apparatus of a direct transfer type, toner images for the respective colors are transferred onto a sheet in an overlapping manner, thereby forming a color image on the sheet. On the other hand, with an image forming apparatus of an intermediate transfer type, toner images for the respective colors are transferred onto an intermediate transfer belt in an overlapping manner, so that a color toner image is formed thereon. Then, the color toner image is transferred onto a sheet, thereby forming a color image on the sheet.

As an image forming apparatus of such tandem type, for example, a configuration in which photosensitive drums for respective colors are integrally held in a photosensitive drum unit that is detachably attachable to a casing has been proposed.

However, in the image forming apparatus configured according to the aforementioned proposal, the photosensitive drum unit may be attached out of a normal attaching position in some cases. Such inaccurate attachment will cause displacement of a color image formed on a sheet, or deformation of a color image. As a result, a good image formation cannot be achieved.

SUMMARY

One aspect of the present invention may provide an image forming apparatus that can achieve a good image formation in a construction in which a photosensitive unit integrally holding a plurality of photosensitive members is detachably attached to an apparatus body.

The same or different aspect of the present invention may provide image forming apparatus including: a main body casing; a reference shaft provided in the main body casing; a photosensitive unit that is detachably attachable to the main body casing along a generally horizontal attachment/detachment direction, the photosensitive unit holding together a plurality of photosensitive members in a state where the plurality of photosensitive members are arranged in parallel in the attachment/detachment direction, the photosensitive unit having an engaging portion for coming into engagement with the reference shaft when the photosensitive unit is attached to the image forming apparatus; a plurality of developing units each of which is detachably attachable to the photosensitive unit and has a developing agent carrier for supplying a developing agent to the photosensitive member; and a pressing member that is configured to linearly move along the attachment/detachment direction between a press position for pressing the developing unit to press the developing agent carrier into contact with the photosensitive member and a press releasing position for releasing this press contact, the pressing member urging the developing unit in a direction in which the engaging portion comes into engagement with the reference shaft in a process of moving from the press releasing position to the press position.

BRIEF DESCRIPTION OF THE DRAWINGS

FIG. 3(*a*) shows a state where no external force acts on the respective pressing projections in all the developer cartridges. FIG. 3(*b*) shows a state where a pressing projection is pressed by a pressuring surface of a pressing member in a black developer cartridge, while no external force acts on the respective pressing projections in the developer cartridges other than the black developer cartridge. FIG. 3(*c*) shows a state where the pressing projection is put under the pressing member in the black developer cartridge, while no external force acts on the respective pressing projections in the developer cartridges other than the black developer cartridge. FIG. 3(*d*) shows a state where the pressing projection is put under the pressing member in the black developer cartridge, while the respective pressing projections is pressed by the respective pressuring surfaces of the pressing members in the developer cartridges other than the black developer cartridge. FIG. 3(*e*) shows a state where the pressing projections are put under the respective pressing members in all the developer cartridges.

DETAILED DESCRIPTION

First Embodiment

1. General Structure of Color Laser Printer

Figure 1:
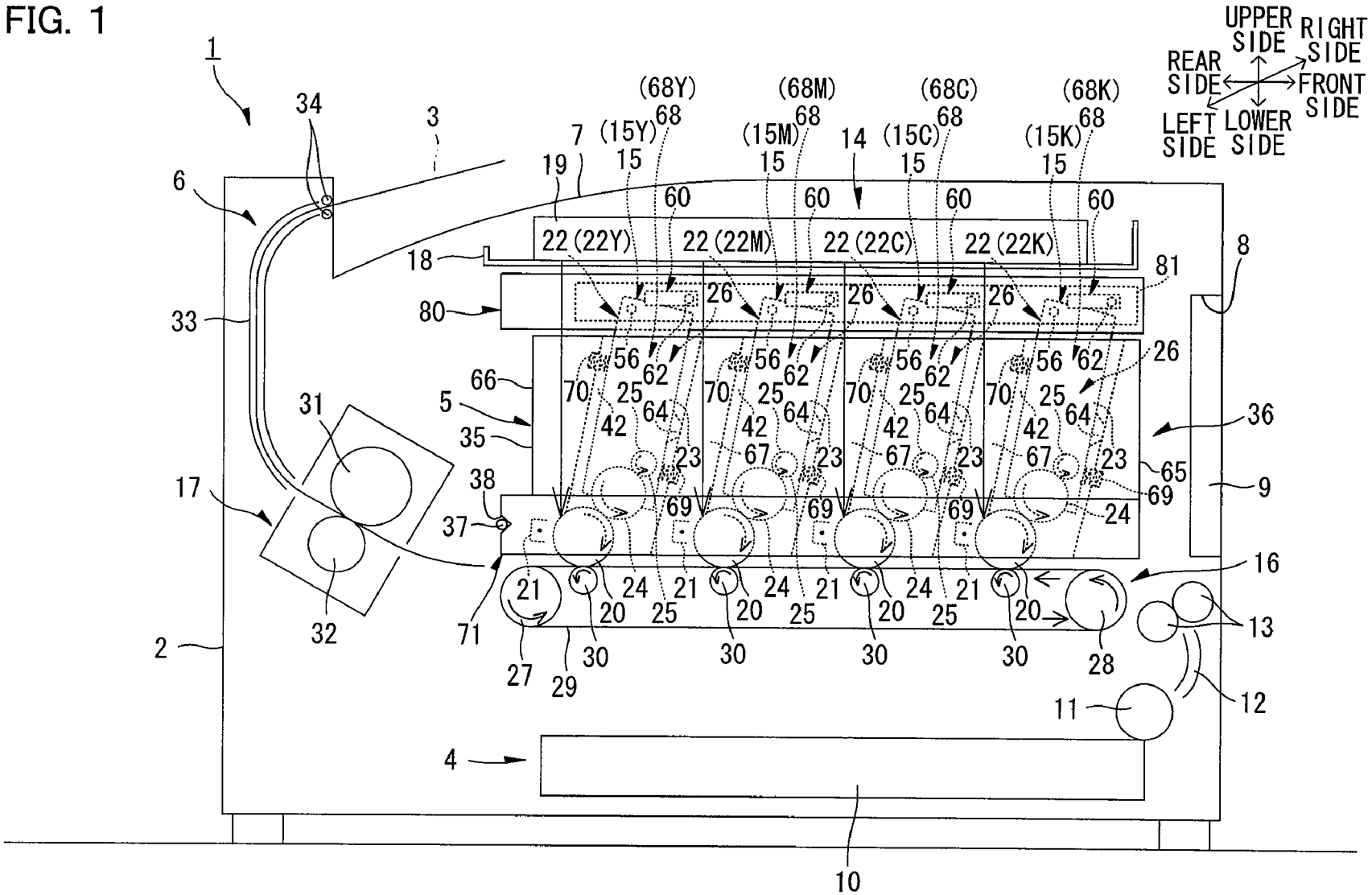
FIG. 1 is a sectional side view showing an illustrative aspect of a color laser printer as an example of an image forming apparatus of one or more aspects of the present invention.

FIG. 1 is a sectional side view showing an illustrative aspect of a color laser printer as an example of an image forming apparatus of one or more aspects of the present invention.

As shown in FIG. 1, the color laser printer 1 is of a tandem type in which a plurality of processing sections 15 are horizontally arranged in parallel, and includes a sheet feeding section 4 for feeding a sheet 3, an image forming section 5 for forming images on the fed sheet 3, and a sheet ejecting section 6 for ejecting the sheet 3 with an image formed thereon, in a main body casing 2 having a box-like shape as an example of a main body casing.

(1) Main Body Casing

A sheet ejection tray 7 for receiving the sheet 3 with the image formed thereon is formed on the upper surface of the main body casing 2. Further, an operation panel (not shown) including an operation key and an LED display portion is also embedded on the upper surface of the main body casing 2 on one side of the sheet ejecting tray 7. In the main body casing 2, a front opening 8 that allows the inside and outside of the main body casing 2 to communicate with each other is formed in a portion upward from an up-and-down center portion of a side wall on the operation panel side. The front opening 8 is provided with a front cover 9 for opening and closing the front opening 8.

In the following description, a side on which the front cover 9 is provided will be referred to as the "front side" of the color laser printer 1, while an opposite side thereto will be referred to as the "rear side". Further, the near side in the paper thickness direction of the FIG. 1 will be referred to as the "left side", while the far side therein will be referred to as the "right side". The left and right direction may be called as the width (lateral) direction.

The front cover 9 is pivotably supported by a cover shaft (not shown) inserted through its lower end portion. When the front cover 9 is closed around the cover shaft as a center, the front opening 8 is closed by the front cover 9. On the contrary, when the front cover 9 is opened (inclined forward) around the cover shaft as a fulcrum, the front opening 8 is opened. When the front opening 8 is opened, the inside of the main body casing 2 (referred to as a "process receiving section 36") is exposed to the outside through this front opening 8. The process receiving section 36 is a space defined in a generally rectangular shape by the inner side surfaces of the both lateral side walls of the main body casing 2, and also by a scanning unit 14, a transferring section 16 and a fixing section 17 all described later. A reference shaft 37 extending between the inner side surfaces of the both widthwise side walls of the main body casing 2 is provided in the lower end portion of the rear end portion of the process receiving section 36. Further, a pressuring mechanism 80 described later is arranged in the upper portion of the process receiving section 36.

(2) Sheet Feeding Section

The sheet feeding section 4 includes a sheet cassette 10 provided on the bottom portion in the main body casing 2, a sheet feeding roller 11 provided on the upper front side of the sheet cassette 10, a sheet feeding transport path 12 provided on the upper front side of the sheet feeding roller 11, and a pair of resist rollers 13 provided at the downstream end portion of the sheet feeding transport path 12.

The sheets 3 are stacked in the sheet cassette 10. An uppermost sheet 3 therein is sent out onto the sheet feeding transport path 12 by the rotation of the sheet feeding roller 11. In the course of transportation of the sheet 3 thus sent out onto the sheet feeding transport path 12, the transport direction of the sheet 3 is reversed. After the registration of the sheet 3 by the resist rollers 13, the sheet 3 is transported to a transfer position between a photosensitive drum 20 serving as an example of a photosensitive member and a transport belt 29 both described later.

(3) Image Forming Section

The image forming section 5 includes the scanning unit 14, the processing sections 15, the transferring section 16, and the fixing section 17.

<Scanning Unit>

The scanning unit 14 is arranged at an upper portion in the main body casing 2 and extends over the plurality of processing sections 15 described later. The scanning unit 14 includes a scanner frame 18 fixed to the main body casing 2, and a scanner casing 19 fixed to the scanner frame 18. In the scanner casing 19, optical members, such as four light sources, a polygonal mirror, an fθ lens, a reflecting mirror, and a face tangle error correcting lens, are arranged. Laser beams emitted from the respective light sources based on image data are deflected and scanned by the polygonal mirror, and pass through the fθ lens and the face tangle error correcting lens. Further, after reflected by the reflecting mirror, the laser beams are irradiated onto surfaces of the photosensitive drums 20 described later for respective colors in the processing section 15 by a high-speed scanning, as shown by the arrows in the figure.

<Processing Section>

The plurality of processing sections 15 are provided corresponding to toners of a plurality of colors. Specifically, the processing sections 15 includes a black processing section 15K, a cyan processing section 15C, a magenta processing section 15M, and a yellow processing section 15Y, in this order from the front side. These four processing sections 15 are accommodated in a process frame 35 having a box-like shape with an upper surface thereof opened. By opening the front opening 8 of the main body casing 2 to move the process frame 35 in a generally horizontal direction, specifically, in a front and rear direction, the four processing sections 15 are together attached to and detached from the main body casing 2 in a slidable manner, and are received in the process receiving section 36 at the time of attachment.

In the process frame 35, three partition walls 67 are anteroposteriorly arranged at the same intervals between a front wall 65 and a rear wall 66 thereof. The inside of the process frame 35 is divided by these partition walls 67, the front wall 65, and the rear wall 66 into a black process receiving section 68K, a cyan process receiving section 68C, a magenta process receiving section 68M, and a yellow process receiving section 68Y, in this order from the front side toward the rear side. Further, the rear surface of the front wall 65, the front surface of the rear wall 66, and the three partition walls 67 are formed so as to be in parallel to one another, and at the same time, to extend and incline from an obliquely lower rear side to an obliquely upper front side. Thus, each of the process receiving sections 68 is formed in a generally parallelogram shape in side view inclining forward. The black process receiving section 68K, the cyan process receiving section 68C, the magenta process receiving section 68M and the yellow process receiving section 68Y accommodate the black processing section 15K, the cyan processing section 15C, the magenta processing section 15M and the yellow processing section 15Y, respectively.

As an example of a first urging member, for example, first springs 69 each made of a coil spring are provided in the lower end portion of the rear surface of the front wall 65 and in the lower end portions of the rear surfaces of the three partition walls 67, respectively, so as to protrude obliquely rearward and upward from the respective rear surfaces at the same positions in the up and down direction. As an example of a second urging member, for example, second springs 70 each made of a coil spring are provided in the upper end portion of the front surface of the rear wall 66 and in the upper end portions of the front surfaces of the three partition walls 67, respectively, so as to protrude obliquely forward and downward from the respective front surfaces at the same positions in the up and down direction.

An engaging portion 38 that is notched so as to be recessed forward from the rear end edge of the rear wall 66, is formed in the lower end portion of the rear wall 66 of the process frame 35.

Each of the processing sections 15 includes the photosensitive drum 20, a scorotron charger 21, and a developer cartridge 22 as an example of a developing unit.

Figure 2:
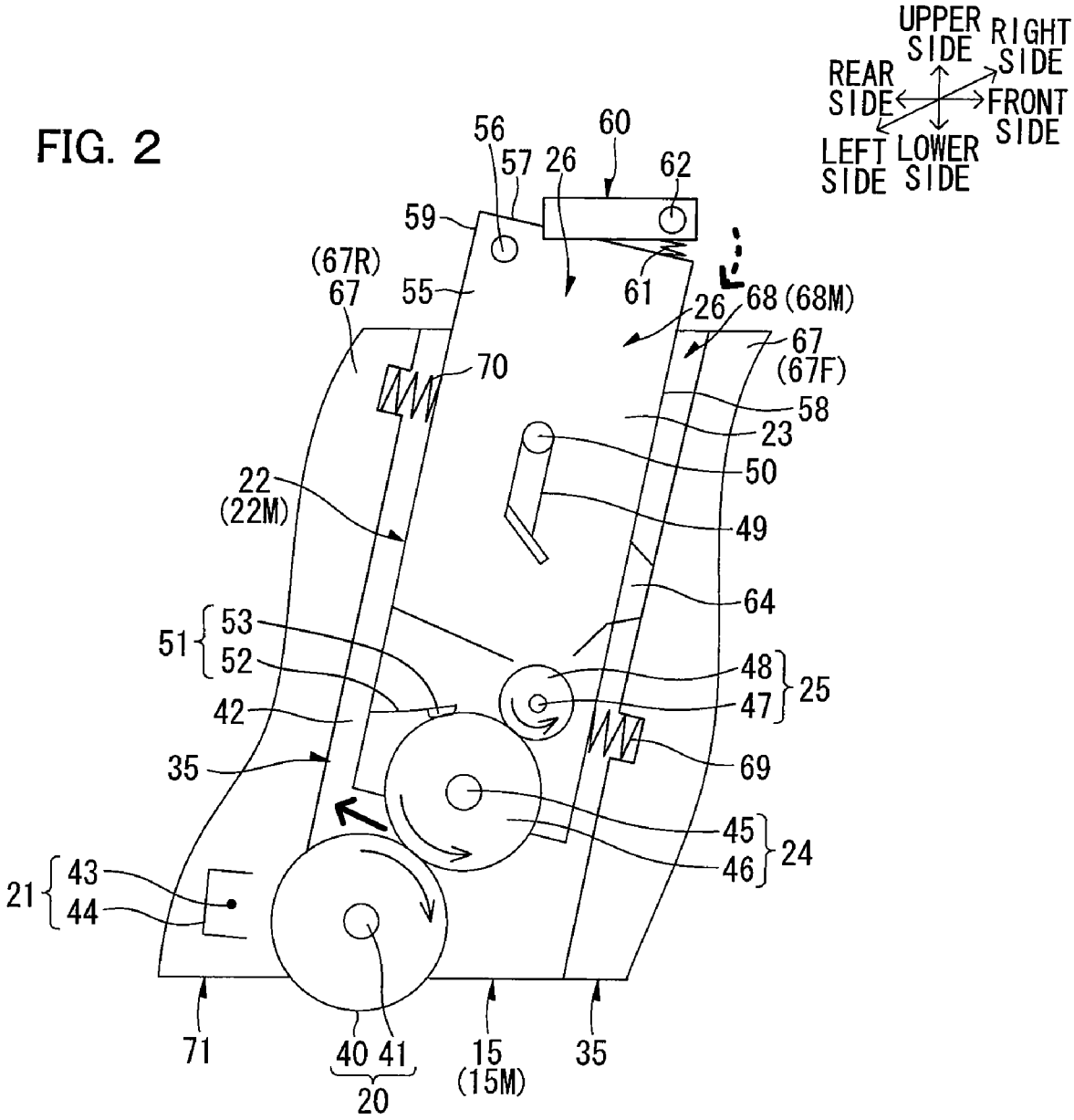
FIG. 2 shows a single processing section (magenta processing section) excerpted from FIG. 1.

FIG. 2 shows a single processing section (magenta processing section) excerpted from FIG. 1.

As shown in FIG. 2, the photosensitive drum 20 is formed in a hollow cylindrical shape, and includes a drum body 40 formed by a positive chargable photosensitive layer having an outermost surface layer of polycarbonate or the like, and a drum shaft 41 extending along the axial direction of the drum body 40 at the axial center of the drum body 40. The drum shaft 41 is unrotatably supported on the both side walls 42 of the process frame 35 in the width direction, and the drum body 40 is rotatable with respect to the drum shaft 41. The drum body 40 is rotationally driven in the clockwise direction by being transmitted with a driving force of a drive motor (not shown) arranged in the main body casing 2.

The scorotron charger 21 is a positively-chargable type scorotron charger including a wire 43 and a grid 44, to which a charging bias is applied to generate corona discharge. The scorotron charger 21 is supported on the process frame 35 in back of the photosensitive drum 20 so as to be opposed to the photosensitive drum 20 at a spaced interval without any contact therewith.

As shown in FIG. 1, the process frame 35, and the four photosensitive drums 20 and scorotron chargers 21 which are held together by the process frame 35 in states of being anteroposteriorly arranged in parallel (tandem), are collectively called as a tandem type photosensitive unit 71. The photosensitive unit 71 is attached to a normal attaching position in the process receiving section 36 of the main body casing 2 when the engaging portion 38 of the process frame 35 comes into engagement with the reference shaft 37 in the process receiving section 36.

The developer cartridges 22 are detachably attached to the photosensitive unit 71 from above. Each of the developer cartridges 22 is arranged in the corresponding process receiving section 68 so as to be positioned obliquely forward above the photosensitive drum 20, and at the same time, to be inclined along the partition wall 67. Each of the developer cartridges 22 is detached/attached in the inclined direction, that is, in the direction along the partition wall 67.

As shown in FIG. 2, the developer cartridge 22 includes a casing 23, and also includes a developing roller 24 as an example of a developing agent carrier, a feed roller 25, and a layer-thickness regulating member 51 that are all arranged in the casing 23. FIG. 2 shows the magenta processing section 15M, so that the partition walls 67 (the partition wall 67 on the front side is referred to as "67F", while the partition wall 67 on the rear side is referred to as "67R") are positioned on the front and rear sides of the developer cartridge 22, respectively.

The casing 23 is formed in a box-like shape with its lower rear end portion opened, and integrally includes a pair of side walls 55 opposed to each other at an interval in the width direction, an upper wall 57 extended between the upper edges of the both side walls 55, a front wall 58 extended between the front edges of the both side walls 55, and a rear wall 59 extended between the rear edges of the both side walls 55 and opposed to the front wall 58. The front wall 58 serves as the under surface of the casing 23 when viewed along the inclined direction of the developer cartridge 22, while the rear wall 59 serves as the upper surface of the casing 23. A spacing projection 56 is provided at the rear end portion in the upper end portion of each of the both side walls 55. The spacing projection 56 is formed in a hollow cylindrical body protruding outward in the width direction from each of the both side walls 55.

Support portions 64 are provided at the both lateral end portions of the front wall 58, respectively. Each of the support portions 64 has a generally trapezoidal shape in side view, is formed at a position lower than the center position of the front wall 58 in the up and down direction, and also between the first spring 69 and the second spring 70 in the up and down direction, and protrudes forward from the outer surface of the front wall 58.

When the developer cartridge 22 is attached in the photosensitive unit 71, the developer cartridge 22 is arranged in an inclined manner as described above. Therefore, the developer cartridge 22 leans on the partition wall 67F on the front side by its own weight, and each of the support portions 64 abuts against the partition wall 67F. In the black developer cartridge 22K (see FIG. 1) in which not the partition wall 67 but the front wall 65 is positioned on the front side, each of the support portions 64 abuts against the rear surface of the front wall 65. In a state where the support portions 64 of the developer cartridge 22 are in abutment against the partition wall 67 or the front wall 65, the developer cartridge 22 is pressed by the first spring 69 and the second spring 70. Specifically, the developer cartridge 22 is attached to the photosensitive unit 71, whereby the first spring 69 and the second spring 70 are more compressed than those before the developer cartridge 22 is attached thereto. Therefore, in the state where the developer cartridge 22 is attached to the photosensitive unit 71, restoring forces of the first spring 69 and the second spring 70 both compressed act on the developer cartridge 22. Specifically, in the developer cartridge 22, the first spring 69 urges a position of the front wall 58 of the casing 23 lower than the support portion 64 in an obliquely rearward and upward direction which is a protruding direction of the first spring 69, and the second spring 70 urges a position of the rear wall 59 of the casing 23 upper than the support portion 64 in an obliquely forward and downward direction which is a protruding direction of the second spring 70.

The upper wall 57 of the casing 23 is provided with a grip 60 formed in a thin plate shape elongated in the width direction. The grip 60 has a swinging shaft (not shown) inserted through its rear end portion along the width direction, and via this swinging shaft (not shown), the grip 60 is swingably supported by the rear end portion of the upper wall 57 of the casing 23. Further, the both lateral end portions of the front end portion of the grip 60 are respectively coupled to the both lateral end portions of the front end portion of the upper wall 57 that are opposed thereto, by elastic members 61, such as coil springs, leaf springs, or sponges. Thus, the front end portion of the grip 60 is normally urged away from the front end portion of the upper wall 57.

Further, a pressing projection 62 as an example of a pressed portion in a hollow-cylindrical shape that protrudes outward in the width direction, is formed at each of the both lateral end portions of the front end portion of the grip 60.

The upper portion of the casing 23 serves as a toner accommodation chamber 26. This toner accommodation chamber 26 accommodates a toner of each color as an example of a developing agent. That is, as shown in FIG. 1, the toner accommodation chamber 26 of the developer cartridge 22 (hereinafter referred to as a "black developer cartridge 22K." The developer cartridges 22 for other colors are also distinguished according to the corresponding colors.) of the black processing section 15K accommodates a positively-chargable, non-magnetic, single-component polymerized toner having a black color. Similarly, the toner accommodation chamber 26 of the cyan developer cartridge 22C of the cyan processing section 15C accommodates a toner having a cyan color; the toner accommodation chamber 26 of the magenta developer cartridge 22M of the magenta processing section 15M accommodates a toner having a magenta color; and the toner accommodation chamber 26 of the yellow developer cartridge 22Y of the yellow processing section 15Y accommodates a toner having a yellow color.

As shown in FIG. 2, the toner accommodation chamber 26 is provided with an agitator 49 for agitating the toner in the toner accommodation chamber 26. The agitator 49 is rotatably supported by an agitator shaft 50 that extends in the width direction at the center portion of the toner accommodation chamber 26, and when the agitator 49 is rotated by this agitator shaft 50, the toner in the toner accommodation chamber 26 is agitated and released downward.

Below the support portions 64, the developing roller 24 is opposed to the photosensitive drum 20 from an obliquely upper front side, and is in press contact with the photosensitive drum 20. The developing roller 24 has a metal roller shaft 45 covered with a roller portion 46 made of an elastic member such as an electrically-conductive rubber material. The roller shaft 45 is rotatably supported on the both lateral side walls of the casing 23. During image formation, a developing bias is applied to the developing roller 24. Further, a driving force of a drive motor (not shown) arranged in the main body casing 2 is transmitted to the developing roller 24, so that the developing roller 24 is rotationally driven in the counterclockwise direction.

The feed roller 25 is opposed to the developing roller 24 from an obliquely upper front side, and is in press contact with the developing roller 24. The feed roller 25 has a metal roller shaft 47 covered with a roller portion 48 made of an electrically-conductive sponge member. The roller shaft 47 is rotatably supported on the both lateral side walls of the casing 23. A driving force of a drive motor (not shown) arranged in the main body casing 2 is transmitted to the feed roller 25, so that the feed roller 25 is rotationally driven in the counterclockwise direction.

The layer-thickness regulating member 51 includes a blade body 52 having its proximal edge supported on the casing 23 and being a metal leaf-spring member, and a pressing portion 53 having a semicircular section that is made of an insulating silicone rubber and provided at the distal end portion of the blade body 52. In the layer-thickness regulating member 51, the pressing portion 53 is in press contact with the surface of the developing roller 24 by an elastic force of the blade body 52, on the rear side of the feed roller 25.

During image formation, the toner accommodated in the toner accommodation chamber 26 of the processing section 15 is agitated by the agitator 49 and released downward, as described above, and is then supplied onto the feed roller 25. The toner is then supplied onto the developing roller 24 by the rotation of the feed roller 25. At this time, the toner thus supplied is positively triboelectrically charged between the developing roller 24 to which a developing bias is applied and the feed roller 25, and enters between the pressing portion 53 of the layer-thickness regulating member 51 and the roller portion 46 of the developing roller 24 along with the rotation of the developing roller 24. Then, the toner forms a thin layer having a certain thickness, and is carried on the roller portion 46 of the developing roller 24.

On the other hand, the scorotron charger 21 generates corona discharge by application of a charging bias, thereby uniformly positively charging the surface of the drum body 40 of the photosensitive drum 20. Along with the rotation of the drumbody 40, the surface thereof is uniformly positively charged by the scorotron charger 21, and thereafter is exposed to a laser beam emitted from an emission window (not shown) of the scanning unit 14 (see FIG. 1) by a high-speed scanning. Thus, an electrostatic latent image of each color corresponding to an image to be formed on a sheet 3 is formed on the drum body 40.

As the drum body 40 further rotates, the developing roller 24 subsequently rotates to come in opposed contact with the photosensitive drum 20. At this time, the positively charged toner carried on the surface of the developing roller 24 is supplied to the electrostatic latent image formed on the surface of the drum body 40, that is, an exposed portion having a lower potential due to the exposure to the laser beam of the surface of the drum body 40 uniformly positively charged. Thus, the electrostatic latent image on the drum body 40 is transformed into a visible image, whereby a toner image by reversal developing corresponding to each color is carried on the surface of the drum body 40.

During such image formation, the rotation speed of the developing roller 24 is set higher than that of the drum body 40 of the photosensitive drum 20 in order to smoothly supply toners onto the drum body 40.

<Transferring Section>

As shown in FIG. 1, the transferring section 16 is anteroposteriorly arranged above the sheet cassette 10 and below the processing section 15, in the main body casing 2. The transferring section 16 includes a driving roller 27, a driven roller 28, the transport belt 29, and a transfer roller 30.

The driving roller 27 is arranged obliquely rearward below the photosensitive drum 20 of the yellow processing section 15Y. The driving roller 27 is rotationally driven in a direction opposite to the rotation direction of the photosensitive drum 20 (counterclockwise in the figure) during image formation.

The driven roller 28 is arranged obliquely forward below the photosensitive drum 20 of the black processing section 15K, and anteroposteriorly opposed to the driving roller 27. The driven roller 28 is driven to rotate in the same direction as the rotation direction of the driving roller 27 (counterclockwise in the figure) during rotational driving of the driving roller 27.

The transport belt 29 is an endless belt formed of a resin such as an electrically-conductive polycarbonate or polyimide in which electrically-conductive particles such as those of carbon are dispersed. The transport belt 29 is wound between the driving roller 27 and the driven roller 28, and is arranged so that the outer contact surface of the transport belt 29 wound around is in opposed contact with all the photosensitive drums 20 of the respective processing sections 15.

The driven roller 28 is driven by the driving of the driving roller 27, and the transport belt 29 circumferentially moves between the driving roller 27 and the driven roller 28 counterclockwise in the figure.

The transfer rollers 30 are arranged in the ring of the transport belt 29 wound between the driving roller 27 and the driven roller 28, in opposed relation to the photosensitive drums 20 of the respective processing sections 15, so as to sandwich the transport belt 29 between the transfer rollers 30 and the photosensitive drums 20. Each of the transfer rollers 30 has a metal roller shaft covered with a roller portion made of an elastic member such as an electrically-conductive rubber material. The roller shaft of the transfer roller 30 is extended in the width direction, and is rotatably supported. Each of the transfer rollers 30 rotates in a direction identical to a circumferential moving direction of the transport belt 29 (counterclockwise in the figure) on the contact surface where the transfer roller 30 is in opposed contact with the transport belt 29. During transfer, a transfer bias is applied to the transfer roller 30.

The sheet 3 fed from the sheet feeding section 4 is transported toward the rear side from the front side by the transport belt 29 that circumferentially moves by the driving of the driving roller 27 and the following movement of the driven roller 28 so that the sheet 3 sequentially passes through the contact positions (transfer positions) between the transport belt 29 and the respective photosensitive drums 20 of the processing sections 15. During the transportation, the toner images corresponding to respective colors carried on the drum bodies 40 (see FIG. 2) of the photosensitive drums 20 of the respective processing sections 15 are sequentially transferred onto the sheet 3, whereby a color image is formed on the sheet 3.

Specifically, for example, when a black toner image carried on the surface of the photosensitive drum 20 of the black processing section 15K is transferred onto a sheet 3, subsequently, a cyan toner image carried on the surface of the photosensitive drum 20 of the cyan processing section 15C is transferred and overlapped onto the sheet 3 where the black toner image has already been transferred. Then, in the same manner as above, a magenta toner image carried on the surface of the photosensitive drum 20 of the magenta processing section 15M, and a yellow toner image carried on the surface of the photosensitive drum 20 of the yellow processing section 15Y are transferred and overlapped onto the sheet 3, whereby a color image is formed on the sheet 3.

<Fixing Section>

The fixing section 17 is arranged in back of the transferring section 16, and includes a heating roller 31 and a pressure roller 32 that pressurizes the heating roller 31. In the fixing section 17, a color image transferred on the sheet 3 is thermally fixed on the sheet 3 by heating and pressurizing the color image, while the sheet 3 passes through between the heating roller 31 and the pressure roller 32.

(4) Sheet Ejecting Section

The sheet ejecting section 6 includes a sheet ejecting transport path 33, sheet ejecting rollers 34, and the sheet ejection tray 7 described above. The sheet 3 having a color image fixed thereon is transported to the sheet ejecting transport path 33, and is then ejected onto the sheet ejection tray 7 by the sheet ejecting rollers 34.

Figure 3:
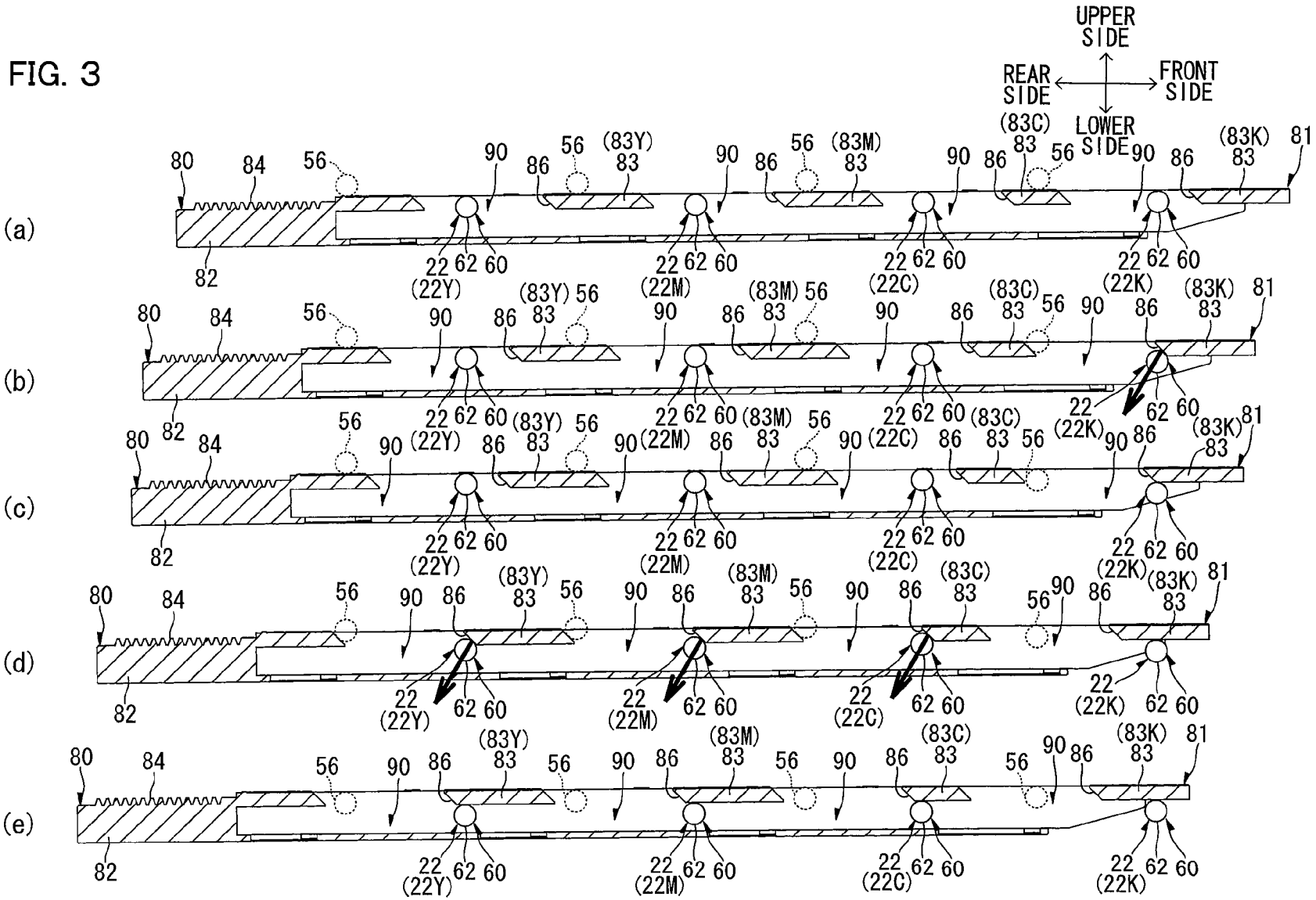
FIGS. 3(*a*), 3(*b*), 3(*c*), 3(*d*), and 3(*e*) are left-side sectional views of the major portion each showing a positional relationship between pressing members of a translation cam that moves anteroposteriorly, and pressing projections of respective developer cartridges.

2. Pressuring of Developing Roller Against Photosensitive Drum (1) Pressuring Mechanism FIGS. 3(*a*), 3(*b*), 3(*c*), 3(*d*), and 3(*e*) are left-side sectional views of the major portion each showing a positional relationship between pressing members of a translation cam that moves anteroposteriorly, and pressing projections of respective developer cartridges. FIG. 3(*a*) shows a state where no external force acts on the respective pressing projections in all the developer cartridges. FIG. 3(*b*) shows a state where a pressing projection is pressed by a pressuring surface of a pressing member in a black developer cartridge, while no external force acts on the respective pressing projections in the developer cartridges other than the black developer cartridge. FIG. 3(*c*) shows a state where the pressing projection is put under the pressing member in the black developer cartridge, while no external force acts on the respective pressing projections in the developer cartridges other than the black developer cartridge. FIG. 3(*d*) shows a state where the pressing projection is put under the pressing member in the black developer cartridge, while the respective pressing projections is pressed by the respective pressuring surfaces of the pressing members in the developer cartridges other than the black developer cartridge. FIG. 3(*e*) shows a state where the pressing projections are put under the respective pressing members in all the developer cartridges.

As shown in FIG. 1, the pressuring mechanism 80 is provided in the upper portion of the process receiving section 36. The pressuring mechanism 80 can receive the pressing projection 62 of each of the developer cartridges 22 of the photosensitive unit 71 accommodated in the process receiving section 36. As shown in FIG. 3, the pressuring mechanism 80 includes a pair of translation cam members 81 arranged at the both lateral ends, and a synchronous moving mechanism (not shown) for connecting the translation cam members 81 with each other to linearly anteroposteriorly move them in synchronization.

Each of the translation cam members 81 includes a cam body plate 82 in the shape of a thin plate anteroposteriorly extending along the inner surfaces of the both lateral side walls of the main body casing 2 (see FIG. 1), and four pressing members 83 each protruding inward in the width direction from the lateral inner surface of the cam body plate 82.

In one translation cam members 81, an input rack gear 84, into which a driving force of a motor (not shown) provided in the main body casing 2 is input, is formed at the upper end portion of the rear end portion of the cam body plate 82.

The pressing members 83 are anteroposteriorly arranged in parallel to one another at the same intervals. Specifically, a gap 90 is formed on the rear side of each of the pressing members 83. The foremost pressing member 83 (hereinafter referred to as a "black pressing member 83K") presses the pressing projection 62 of the black developer cartridge 22K as describe later. The second pressing member 83 from the front (hereinafter referred to as a "cyan pressing member 83C") presses the pressing projection 62 of the cyan developer cartridge 22C. The third pressing member 83 from the front (hereinafter referred to as a "magenta pressing member 83M") presses the pressing projection 62 of the magenta developer cartridge 22M. The fourth pressing member 83 from the front, which is the rearmost one, (hereinafter referred to as a "yellow pressing member 83Y") presses the pressing projection 62 of the yellow developer cartridge 22Y.

The pressing member 83 is formed in the shape of a plate extending anteroposteriorly. The under surface of the pressing member 83 is an anteroposteriorly flat surface. The under surfaces of the black pressing member 83K, magenta pressing member 83M and yellow pressing member 83Y are set to have a generally equal anteroposterior length. On the other hand, the under surface of the cyan pressing member 83C is set to have a shorter length than the under surfaces of the other pressing members 83.

The rear end face of the pressing member 83 is inclined obliquely forward and downward. When the translation cam member 81 moves toward the rear side, the rear end face of the pressing member 83 serves as a pressuring surface 86 for pressing the pressing projection 62 of the developer cartridge 22 obliquely rearward and downward.

The synchronous moving mechanism (not shown) is configured such that, along with the linear movement of the one translation cam member 81 where the input rack gear 84 is formed and a driving force of a motor (not shown) is input, the driving force is transmitted to the other translation cam member 81 where the input rack gear 84 is not formed, for linear movement. Therefore, when a driving force is input into the one translation cam member 81 having the input rack gear 84 from the motor (not shown) through the input rack gear 84, the synchronous moving mechanism (not shown) transmits the driving force from the motor (not shown) to the other translation cam member 81 not having the input rack gear 84, whereby the pair of translation cam members 81 perform anteroposterior movement together.

(2) Pressuring Operation

As shown in FIG. 3(*a*), when the translation cam members 81 are positioned at the foremost positions, the photosensitive unit 71 (see FIG. 1) attached with the developer cartridges 22 is received in the process receiving section 36 of the main body casing 2. The pressing projections 62 of the respective developer cartridges 22 are arranged in the gaps 90 behind the pressing members 83 corresponding to the respective developer cartridges 22 so as to be anteroposteriorly spaced in opposed relation to the corresponding pressuring surfaces 86 of the pressing members 83. At this time, the opposed distance between the pressuring surface 86 of the cyan pressing member 83C and the pressing projection 62 of the cyan developer cartridge 22C, that between the pressuring surface 86 of the magenta pressing member 83M and the pressing projection 62 of the magenta developer cartridge 22M, and that between the pressuring surface 86 of the yellow pressing member 83Y and the pressing projection 62 of the yellow developer cartridge 22Y, are equal. On the other hand, the opposed distance between the pressuring surface 86 of the black pressing member 83K and the pressing projection 62 of the black developer cartridge 22K is shorter than the aforementioned opposed distances between the pressuring surfaces 86 of the other pressing members 83 and the pressing projections 62 of the corresponding developer cartridges 22.

In this state, no external force acts on the pressing projections 62 of the respective developer cartridges 22. At this time, in each of the developer cartridges 22, the developing roller 24 (see FIG. 2) is in a press releasing state of not being in press contact with the photosensitive drum 20 (see FIG. 2).

When each of the developing rollers 24 is in the press releasing state, a spacing mechanism (not shown) causes an upward pressure force to act on the respective spacing projections 56, whereby the developer cartridges 22 ascend for a given distance. As a result, the developing rollers 24 (see FIG. 2) can be spaced away from the respective photosensitive drums 20 (see FIG. 2). In all the developer cartridges 22, this ensures that no toner is supplied from the developing roller 24 to the photosensitive drum 20, and undesirable wear due to the contact between the developing roller 24 and the photosensitive drum 20 can be prevented.

The anteroposterior position of each of the pressing members 83 when the developing rollers 24 are in the press releasing state, is referred to as a press releasing position.

While the respective developing rollers 24 are in the press releasing state, when a driving force of a motor (not shown) is input into the input rack gear 84, the translation cam members 81 move rearward.

As this rearward movement of the translation cam members 81 progresses, the pressing projection 62 in the black developer cartridge 22K is abutted against the pressuring surface 86 of the black pressing member 83 K, as shown in FIG. 3(*b*). As the translation cam members 81 further move rearward, the pressing projection 62 of the black developer cartridge 22K is pressed rearward by the pressuring surface 86. The pressuring surface 86 is inclined obliquely forward and downward, so that an urging force obliquely rearward and downward (see the thick-line arrow shown in the figure) that is orthogonal to the inclined direction of the pressuring surface 86 is imparted to the pressing projection 62 of the black developer cartridge 22K.

As the rearward movement of the translation cam members 81 further progresses, in the black developer cartridge 22K, the pressing projection 62 moves downward along the pressuring surface 86 of the black pressing member 83K, to be put under the black pressing member 83K, as shown in FIG. 3(*c*). Thus, the black pressing member 83K abuts against the pressing projection 62 of the black developer cartridge 22K from above and presses the pressing projection 62 downward. Then, as shown in FIG. 2, the grip 60 tilts in a direction in which the grip 60 approaches the upper wall 57 of the casing 23 (direction of the dashed arrow shown in FIG. 2), and the elastic member 61 is compressed. An urging force of the elastic member 61 due to the compression is input into the upper wall 57, so that the casing 23 is urged obliquely rearward and downward (in the attaching direction of the developer cartridge 22). This puts the developing roller 24 in a press state with respect to the photosensitive drum 20. In this state, in each of the developer cartridges 22 other than the black developer cartridge 22K, the pressing projection 62 is not in contact with the pressing member 83, and is anteroposteriorly opposed to the pressuring surface 86 at an interval.

When the developing roller 24 of the black developer cartridge 22K is in press contact, the developing rollers 24 of the developer cartridges 22 other than the black developer cartridge 22K are left spaced away from the respective photosensitive drums 20, as described above, so that the toner from the developing roller 24 of the black developer cartridge 22K is supplied only to the photosensitive drum 20 of the black processing section 15K, thereby making it possible to form a monochrome image.

Further, the anteroposterior position of the pressing member 83 when the developing roller 24 is in press contact, is referred to as a press position.

As the rearward movement of the translation cam members 81 further progresses, the respective pressing projections 62 in the developer cartridges 22 other than the black developer cartridge 22K are abutted against the respective pressuring surfaces 86 of the corresponding pressing members 83 (cyan pressing member 83C, magenta pressing member 83M, and yellow pressing member 83Y) all at once, as shown in FIG. 3(*d*). As the translation cam members 81 further move rearward, the respective pressing projections 62 of the developer cartridges 22 other than the black developer cartridge 22K are pressed rearward by the pressuring surfaces 86 of the corresponding pressing members 83. The pressuring surfaces 86 are inclined obliquely forward and downward, so that urging forces in the obliquely rearward and downward direction (see the thick-line arrow shown in the figure) that is orthogonal to the inclined directions of the pressuring surfaces 86, are imparted to the respective pressing projections 62 of the developer cartridges 22 other than the black developer cartridge 22K. On the other hand, the black pressing member 83K is positioned at the press position, and the developing roller 24 of the black developer cartridge 22K is in the press state.

As the rearward movement of the translation cam members 81 further progresses, the respective pressing projections 62 in the developer cartridges 22 other than the black developer-cartridge 22K move downward along the respective pressuring surfaces 86 of the corresponding pressing members 83 (cyan pressing member 83C, magenta pressing member 83M, and yellow pressing member 83Y), to be put under these three pressing members 83. Therefore, each of the developing rollers 24 is put in the press state, as shown in FIG. 3(*e*). In this state, the cyan pressing member 83C, the magenta pressing member 83M, and the yellow pressing member 83Y are positioned at the press position. The black pressing member 83K is also positioned at the press position and the developing roller 24 of the black developer cartridge 22K is in the press state, so that, in all the developer cartridges 22, the toners from the respective developing rollers 24 are supplied to the respective photosensitive drums 20, thereby making it possible to form a color image.

When the translation cam member 81 is moved forward from the state shown in FIG. 3(*e*), the translation cam member 81 can be returned to each of the states shown in FIGS. 3(*a*) to 3(*d*).

In this way, the color laser printer 1 can selectively form a color image and a monochrome image according to the purposes of users. More particularly, when the aforementioned operation panel (not shown) is operated to select whether an image formation is performed in collar or in monochrome, a CPU (not shown) provided in the main body casing 2 drives a motor (not shown) according to the selection, thereby anteroposteriorly moving the translation cam members 81 to the states shown in FIGS. 3(*a*) to 3(*e*).

3. Operations and Effects

In such color laser printer 1, as shown in FIG. 3, when each pressing member 83 is moved from the press releasing position to the press position, the developing roller 24 (see FIG. 2) provided in each developer cartridge 22 can be pressed into contact with the photosensitive drum 20 (see FIG. 2). In the process of moving from the press releasing position to the press position, the respective pressing members 83 urge the corresponding developer cartridges 22 in a direction in which the engaging portion 38 (see FIG. 1) of the photosensitive unit 71 comes into engagement with the reference shaft 37 (see FIG. 1) provided in the main body casing 2. More specifically, in the black developer cartridge 22K, as shown in FIG. 3(*b*), the pressing projection 62 is pressed by the pressuring surface 86 of the black pressing member 83K, and an urging force is imparted to this pressing projection 62 obliquely rearward and downward (see the thick-line arrow shown in the figure). Of the urging force, a component force mainly urging downward acts for swinging the grip 60 to press the developing roller 24 into contact with the photosensitive drum 20, and a component force mainly urging rearward acts for bringing the engaging portion 38 of the photosensitive unit 71 into engagement with the reference shaft 37. In the developer cartridges 22C, 22M, and 22Y other than the black developer cartridge 22K, as shown in FIG. 3(*d*), the pressing projections 62 are pressed by the respective pressuring surfaces 86 of the corresponding pressing members 83C, 83M, and 83Y, and urging forces are imparted to these pressing projections 62 obliquely downward and rearward (see the thick-line arrow shown in the figure). Of each of the urging forces, a component force mainly downward acts for swinging each of the grips 60 of the developer cartridges 22C, 22M and 22Y to pressure each of the developing rollers 24 into contact with the corresponding photosensitive drum 20, and a component force mainly rearward acts for bringing the engaging portion 38 of the photosensitive unit 71 into engagement with the reference shaft 37.

As described above, when the engaging portion 38 comes into engagement with the reference shaft 37, the photosensitive unit 71 is attached to the normal attaching position in the process receiving section 36 of the main body casing 2, whereby the urging force of the pressing member 83 against the pressing projection 62 described above can reliably lead the photosensitive unit 71 to the normal attaching position. This can prevent image formation in a state where the attaching position of the photosensitive unit 71 has shifted from the normal attaching position. As a result, a good image formation can be achieved.

Further, the simple construction such that the pressuring surface 86 provided on each of the pressing members 83 presses the pressing projection 62 provided in each of the developer cartridges 22, can lead the photosensitive unit 71 to the normal attaching position. This can avoid the cost increase by separately providing a construction for leading the photosensitive unit 71 to the normal attaching position.

As shown in FIG. 2, the pressing projection 62 is provided on the grip 60. By grasping of the grip 60 the developer cartridge 22 can be moved, so that operability of the developer cartridge 22 can be excellent. Further, the number of components can be reduced, comparing with the case where the pressing projection 62 is formed on a separate member from the grip 60.

As shown in FIG. 1, each of the developer cartridges 22 is attached to the photosensitive unit 71 in a state where the casing 23 thereof is inclined with respect to a generally horizontal direction, and more specifically, in a state where the casing 23 is inclined along the partition wall 67 that extends and inclines from an obliquely lower rear side to an obliquely upper front side. Since the support portion 64 is provided on the front wall 58 (see FIG. 2) serving as the under surface of the casing 23 of the developer cartridge 22, when the developer cartridge 22 is attached in the photosensitive unit 71, the support portion 64 is abutted against the rear surface of the front wall 65 or the partition wall 67 of the photosensitive unit 71 by the weight of the developer cartridge 22, and the developer cartridge 22 is stably supported by the photosensitive unit 71 through the support portion 64. Therefore, wobbling of the developer cartridge 22 attached in the photosensitive unit 71 can be suppressed.

Since the rotation speed of the developing roller 24 is set higher than that of the drum body 40 of the photosensitive drum 20 in order to smoothly supply the toner onto the drum body 40 during image formation, the developing roller 24 during driving receives a reaction force in response to the difference in the rotation speed with respect to the drum body 40, from the photosensitive drum 20. As shown in FIG. 2, this reaction force acts on the developer cartridge 22 as a moment toward the solid-line arrow direction in the figure with the support portion 64 as a fulcrum. On the other hand, the first spring 69 urges a position offset from the support portion 64 of the casing 23 of the developer cartridge 22 to the developing roller 24 side, that is, a position of the front wall 58 lower than the support portion 64, in the obliquely rearward and upward direction which is the projecting direction of the first spring 69. This urging allows a portion on the developing roller 24 side with respect to the support portion 64 of the developer cartridge 22 to be pressed against the photosensitive unit 71 in the same direction (see the solid-line arrow in the figure) as that of the moment described above, with the support portion 64 as a fulcrum. Further, the second spring 70 urges a position offset from the support portion 64 of the upper surface of the casing 23 to the opposite side to the developing roller 24 side, that is, a position of the rear wall 59 upper than the support portion 64, in the obliquely forward and downward direction which is the projecting direction of the second spring 70. This urging allows a portion on the opposite side to the developing roller 24 side with respect to the support portion 64 of the developer cartridge 22 to be pressed against the photosensitive unit 71 in the same direction as that of the moment described above, with the support portion 64 as a fulcrum. Therefore, further stable support of the developer cartridge 22 can be achieved, whereby wobbling of the developer cartridge 22 during the driving of the photosensitive drum 20 and the developing roller 24 can be reliably suppressed.

Specifically, since the second spring 70 urges the portion on the opposite side to the developing roller 24 side with respect to the support portion 64 of the developer cartridge 22 in a direction in which the aforementioned portion on the opposite side moves by the urging of the first spring 69, the direction of the moment produced in the developer cartridge 22 by the urging of the first spring 69 is identical to the direction of the moment produced in the developer cartridge 22 by the urging of the second spring 70, whereby wobbling of the developer cartridge 22 during the driving of the photosensitive drum 20 and the developing roller 24 can be reliably suppressed.

The first spring 69 and the second spring 70 are provided in the photosensitive unit 71. More specifically, as shown in FIG. 1, the first springs 69 are provided on the rear surface of the front wall 65 and the rear surfaces of the three partition walls 67, respectively, and the second springs 70 are provided on the front surface of the rear wall 66 and the front surfaces of the three partition walls 67, respectively. Therefore, the urging forces and their reaction forces by the first spring 69 and the second spring 70 against the developer cartridge 22 do not act on the photosensitive unit 71 as external forces, whereby shifting of the photosensitive unit 71 from the normal attaching position can be reliably prevented.

Further, as shown in FIG. 2, the support portion 64 is arranged at a position offset to the developing roller 24 side from the center of the under surface of the casing 23 in the inclined direction, that is, a position of the front wall 58 lower than the center position in the up and down direction. During the driving of the photosensitive drum 20 and the developing roller 24, the moment described above with the support portion 64 as a fulcrum, is produced by the force which the developing roller 24 receives from the photosensitive drum 20. However, the distance between the developing roller 24 which is the point where the force is input and the support portion 64 is short, so that the moment produced in the developer cartridge 22 can be reduced, whereby wobbling of the developer cartridge 22 during the driving of the photosensitive drum 20 and the developing roller 24 can be further reliably suppressed.

Second Embodiment

Each of the embodiments mentioned above shows as an example the color laser printer 1 of a direct transfer tandem type for directly transferring toner images onto a sheet 3 from respective photosensitive drums 20. However, the present invention is not limited thereto, and can be constituted, for example, as a color laser printer of an intermediate transfer type in which toner images for respective colors are once transferred to an intermediate transfer body from respective photosensitive members, and thereafter, transferred onto a sheet by one operation.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

a main body casing;

a reference shaft provided in the main body casing;

a photosensitive unit that is detachably attachable to the main body casing along a generally horizontal attachment/detachment direction, the photosensitive unit holding together a plurality of photosensitive members in a state where the plurality of photosensitive members are arranged in parallel in the attachment/detachment direction, the photosensitive unit having an engaging portion for coming into engagement with the reference shaft when the photosensitive unit is attached to the image forming apparatus;

a plurality of developing units each of which is detachably attachable to the photosensitive unit and has a developing agent carrier for supplying a developing agent to the photosensitive member; and a pressing member that is configured to linearly move along the attachment/detachment direction between a press position for pressing the developing unit to press the developing agent carrier into contact with the photosensitive member and a press releasing position for releasing this press contact, the pressing member urging the developing unit in a direction in which the engaging portion comes into engagement with the reference shaft in a process of moving from the press releasing position to the press position, wherein the developing unit has a pressed portion that is pressed by the pressing member, and wherein the pressing member has a pressuring surface that is inclined with respect to the attachment/detachment direction so as to abut against the pressed portion to press the pressed portion in a direction in which the engaging portion comes into engagement with the reference shaft, in the process of moving from the press releasing position to the press position.

2. The image forming apparatus according to claim 1, wherein the developing unit comprises a grip that is operated when the developing unit is moved, and the pressed portion is provided on the grip.

3. The image forming apparatus according to claim 1, wherein the developing unit is attached to the photosensitive unit such that a casing of the developing unit is inclined with respect to the attachment/detachment direction, and wherein the developing unit comprises, on an under surface of the casing along the inclined direction, a support portion configured to abut against and be supported by the photosensitive unit.

4. The image forming apparatus according to claim 3, comprising a first urging member that is configured to urge a position offset from the support portion of the developing unit to the developing agent carrier side.

5. The image forming apparatus according to claim 4, wherein the first urging member is provided in the photosensitive unit.

6. The image forming apparatus according to claim 4, comprising a second urging member that is configured to urge a position offset from the support portion of the developing unit to an opposite side of the developing agent carrier side.

7. The image forming apparatus according to claim 6, wherein the second urging member is provided in the photosensitive unit.

8. The image forming apparatus according to claim 3, comprising an urging member configured to, when driving the photosensitive member and the developing agent carrier, urge the developing unit in a direction of a moment produced in the developing unit with the support portion as a fulcrum.

9. The image forming apparatus according to claim 8, wherein the urging member comprises a first urging member that is configured to urge a position offset from the support portion of the under surface of the casing to the developing agent carrier side.

10. The image forming apparatus according to claim 9, wherein the first urging member is provided in the photosensitive unit.

11. The image forming apparatus according to claim 9, wherein the urging member comprises a second urging member that is configured to urge a position offset from the support portion of an upper surface of the casing opposed to the under surface of the casing, to an opposite side of the developing agent carrier side.

12. The image forming apparatus according to claim 11, wherein the second urging member is provided in the photosensitive unit.

13. The image forming apparatus according to claim 3, wherein the support portion is arranged in a position offset from a center of the under surface of the casing in the inclined direction toward the developing agent carrier side.

* * * * *